US008712265B2

(12) United States Patent
Watanabe

(10) Patent No.: US 8,712,265 B2
(45) Date of Patent: Apr. 29, 2014

(54) IMAGE FORMING APPARATUS WITH AN IMPROVED DENSITY ADJUSTMENT UNIT

(75) Inventor: Masaru Watanabe, Osaka (JP)

(73) Assignee: Kyocera Document Solutions, Inc. (JP)

( * ) Notice: Subject to any disclaimer, the term of this patent is extended or adjusted under 35 U.S.C. 154(b) by 352 days.

(21) Appl. No.: 13/236,861

(22) Filed: Sep. 20, 2011

(65) Prior Publication Data

US 2012/0243891 A1 Sep. 27, 2012

(30) Foreign Application Priority Data

Mar. 24, 2011 (JP) ..... 2011-066766
Apr. 27, 2011 (JP) ..... 2011-098982

(51) Int. Cl.
*G03G 15/00* (2006.01)

(52) U.S. Cl.
USPC ..... 399/49; 399/72

(58) Field of Classification Search
USPC ..... 399/49, 72
See application file for complete search history.

(56) References Cited

U.S. PATENT DOCUMENTS

| | | | | |
|---|---|---|---|---|
| 7,650,094 | B2 * | 1/2010 | Yamamoto et al. | 399/72 |
| 7,903,988 | B2 * | 3/2011 | Ozaki et al. | 399/49 |
| 2011/0052230 | A1 | 3/2011 | Isoda | |

FOREIGN PATENT DOCUMENTS

| | | |
|---|---|---|
| JP | H10-240041 | 9/1998 |
| JP | 2006-276511 | 10/2006 |
| JP | 2011-048202 | 10/2011 |

* cited by examiner

*Primary Examiner* — William J Royer
(74) *Attorney, Agent, or Firm* — Stephen Chin

(57) ABSTRACT

In an image forming apparatus, a density adjustment unit causes to form a cleaner toner image on a surface of an image carrier and remove the cleaner toner image for density adjustment, and causes to form a test pattern after removing the cleaner toner image. The cleaner toner image is formed to cover a whole area on which the test pattern may be formed.

7 Claims, 6 Drawing Sheets

IMAGE FORMING APPARATUS WITH AN IMPROVED DENSITY ADJUSTMENT UNIT

CROSS-REFERENCE TO RELATED APPLICATIONS

This application relates to and claims priority rights from Japanese Patent Applications: No. 2011-098982, filed on Apr. 27, 2011 and No. 2011-066766, filed on Mar. 24, 2011, the entire disclosures of which are hereby incorporated by reference herein.

BACKGROUND OF THE INVENTION

1. Field of the Invention

This invention relates to image forming apparatuses.

2. Description of the Related Art

In an electrophotographic image forming apparatus such as a printer, copier, facsimile machine, or multifunction peripheral thereof, the toner amount (i.e. toner density) of a toner image formed on a photoconductor (e.g. photoconductor drum) directly affects on the quality of a print image. The toner density changes over time according to some conditions such as usage environment and usage time length. For instance, while keeping a developing bias of the photoconductor constant, changing an electrostatic charging characteristic due to its atmosphere may result in reducing toner supplied from a development unit to the photoconductor.

Since a cleaning blade for cleaning the photoconductor and an intermediate transfer member contact the photoconductor and grind its photoreceptor layer, increasing the number of times of image forming results in decreasing the thickness of the photoreceptor layer, and consequently surface electrostatic potential of the photoconductor is difficult to keep constant. Gradually decreasing the surface electrostatic potential results in gradually increasing the toner density of a toner image and degrading image quality.

In order to solve this problem, a toner image for density adjustment (hereinafter called "test pattern") is carried on a predetermined area of the intermediate transfer member to which a toner image formed on the photoconductor is primary transferred, the density of the test pattern is measured with a sensor, and the toner density is adjusted by controlling process conditions such as developing bias according to the measurement result. For example, the test pattern is formed so as to contain areas with gradually different toner densities.

The reflectance of a surface material of the intermediate transfer member affects on the measurement result of the test pattern. Contacting a cleaning member, a transfer roller for secondarily transferring a toner image on a record medium such as a paper sheet and the like to the surface of the intermediate transfer member results in staining and scratching the surface and adhering a toner external additive to the surface. Therefore, a surface condition of the intermediate transfer member is measured with the sensor before forming the test pattern, and the toner density is adjusted with taking into account the detection value of the sensor.

SUMMARY OF THE INVENTION

A two-component developer used for development of a toner image in the image forming apparatus has toner and carrier, and an external additive such as titanium oxide is attached to the toner.

Due to a developing bias and a primary transfer bias applied when a toner image is developed, the external additive separates and flies from the toner, and adheres on the surface of the intermediate transfer member. Therefore, the external additive adheres on the surface material where the test pattern is formed. As the result, the surface condition of the intermediate transfer member before forming the test pattern may not be measured correctly. When the surface condition of the intermediate transfer member before forming the test pattern is not measured correctly, the toner density is also not measured correctly, and consequently the toner density adjustment is not performed correctly.

Since various shapes of toner images are transferred on the intermediate transfer member in printing before the density adjustment, and residual toner on the intermediate transfer member is removed after transferring each of the toner images to a print paper sheet, the amount of the external additive which adheres on the intermediate transfer member is not uniform. Therefore, it is difficult to correctly determine the surface condition of the intermediate transfer member before forming the test pattern.

FIGS. 6A to 6F show an instance of surface condition change of an intermediate transfer belt 101.

An external additive adheres on a whole surface of the intermediate transfer belt 101 as shown in FIG. 6A. A test pattern which contains respective patch images 111 to 113 of densities as shown in FIG. 6B is transferred on the intermediate transfer belt 101.

After measuring the toner densities of the patch images 111 to 113 with a sensor, when the test pattern is removed, an external additive on the area where the test pattern is formed is removed together with the test pattern. Consequently, as shown in FIG. 6C, areas 121 appear with a small amount of the external additive.

In the next density adjustment, if a test pattern is transferred when the intermediate transfer belt 101 is placed as shown in FIG. 6D, then as shown in FIG. 6E, the test pattern is transferred on a position different from the areas 121 on which the test pattern was transferred in the previous density adjustment.

The toner pattern shown in FIG. 6E is removed after measuring the toner densities, and therefore, as shown in FIG. 6F, the amount of the external additive on areas 131 where this toner pattern was removed is different from that on the areas 122 where the previous toner pattern had been removed.

This invention has been conceived in order to solve this problem, and provide an image forming apparatus which correctly performs toner density adjustment by measuring correct toner density even if an external additive is added to toner.

The Present Invention Solves this Problem as Follows.

An image forming apparatus according to an aspect of the present invention has an image carrier that carries a toner image; a sensor that detects measurement light from a test pattern on a surface of the image carrier for density adjustment; and a density adjustment unit that causes to form a cleaner toner image on the surface of the image carrier and remove the cleaner toner image for the density adjustment, and causes to form the test pattern after removing the cleaner toner image. The cleaner toner image covers a whole area on which the test pattern may be formed.

When the cleaner toner image is removed by a cleaning member, an external additive which adheres on an area where the cleaner toner image is formed is removed together with the cleaner toner image, and therefore, the amount of the external additive on an area which will carry the test pattern is maintained to be uniform. Consequently, correct toner density is measured even if an external additive is attached to toner, and toner density adjustment is performed correctly.

An image forming apparatus according to another aspect of the present invention has a handler belt that conveys a record medium to a photoconductor and carries a test pattern for density adjustment; a sensor that detects measurement light from the test pattern on a surface of the handler belt; and a density adjustment unit that causes to form a cleaner toner image on the surface of the handler belt and remove the cleaner toner image for the density adjustment, and causes to form the test pattern after removing the cleaner toner image. The cleaner toner image covers a whole area on which the test pattern may be formed.

These and other objects, features and advantages of the present invention will become more apparent upon reading of the following detailed description along with the accompanied drawings.

DETAILED DESCRIPTION OF THE PREFERRED EMBODIMENT

Hereinafter, embodiments according to aspects of the present invention will be explained with reference to the drawings.

Figure 1:
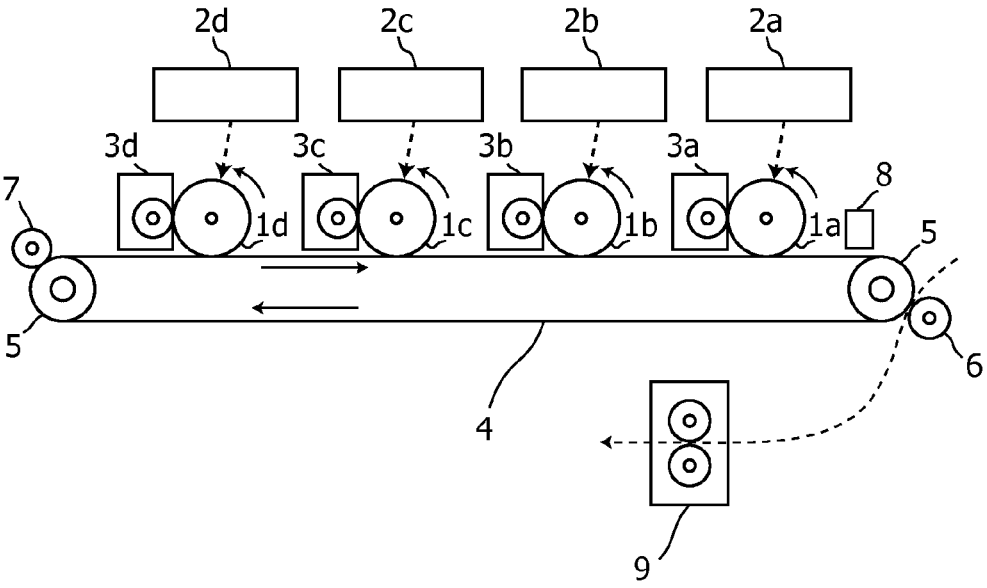
FIG. 1 is a side view that partially shows a mechanical internal configuration of an image forming apparatus in an embodiment according to this invention.

FIG. 1 is a side view that partially shows a mechanical internal configuration of an image forming apparatus in an embodiment according to this invention. The image forming apparatus is an apparatus having a printing function such as a printer, facsimile machine, copier, or multifunction peripheral.

The image forming apparatus in this embodiment has a tandem-type color development device. This color development device has photoconductor drums 1*a* to 1*d*, exposure devices 2*a* to 2*d*, and development units 3*a* to 3*d*. The photoconductor drums 1*a* to 1*d* are four color photoconductors of Cyan, Magenta, Yellow and Black. The exposure devices 2*a* to 2*d* are devices that form electrostatic latent images by irradiating laser light to the photoconductor drums 1*a* to 1*d*. Each of the exposure devices 2*a* to 2*d* has a laser diode as a light source of the laser light, optical elements (such as lens, mirror and polygon mirror) that guide the laser light to the photoconductor drum 1*a*, 1*b*, 1*c*, or 1*d*.

Further, in the periphery of each of the photoconductor drums 1*a* to 1*d*, a charging unit such as a scorotron, a cleaning device, a static electricity eliminator and the like are disposed. The cleaning device removes residual toner on the photoconductor drum 1*a*, 1*b*, 1*c*, or 1*d* after primary transfer. The static electricity eliminator eliminates static electricity on the photoconductor drum 1*a*, 1*b*, 1*c*, or 1*d* after primary transfer.

Toner containers contain toner of four colors: Cyan, Magenta, Yellow and Black, and are attached to the development units 3*a* to 3*d*, respectively. In the development units 3*a* to 3*d*, the toner is supplied from the toner containers, and this toner and carrier compose a developer. An external additive such as titanium oxide is attached to the toner. The development units 3*a* to 3*d* form toner images by attaching the toner to electrostatic latent images on the photoconductor drums 1*a* to 1*d*.

The photoconductor drum 1*a*, the exposure device 2*a* and the development unit 3*a* perform development of Magenta. The photoconductor drum 1*b*, the exposure device 2*b* and the development unit 3*b* perform development of Cyan. The photoconductor drum 1*c*, the exposure device 2*c* and the development unit 3*c* perform development of Yellow. The photoconductor drum 1*d*, the exposure device 2*d* and the development unit 3*d* perform development of Black.

An intermediate transfer belt 4 is a loop-shaped image carrier, and contacts the photoconductor drums 1*a* to 1*d*. Toner images on the photoconductor drums 1*a* to 1*d* are primarily transferred onto the intermediate transfer belt 4. The intermediate transfer belt 4 is an intermediate transfer member. The intermediate transfer belt 4 is hitched round driving rollers 5, and rotates by driving force of the driving rollers 5 towards the direction from the contact position with the photoconductor drum 1*d* to the contact position with the photoconductor drum 1*a*.

A transfer roller 6 makes a paper sheet being conveyed contact the transfer belt 4, and secondarily transfers the toner image on the intermediate transfer belt 4 to the paper sheet. The paper sheet on which the toner image has been transferred is conveyed to a fixer 9, and consequently, the toner image is fixed on the paper sheet.

A roller 7 has a cleaning brush, and removes residual toner on the intermediate transfer belt 4 by contacting the cleaning brush to the intermediate transfer belt 4 after transferring the toner image to the paper sheet. In density adjustment, the roller 7 also removes an external additive with toner carried on an area where the external additive adheres on the intermediate transfer belt 4.

A sensor 8 irradiates light to the intermediate transfer belt 4 and detects its reflection light. In density adjustment, the sensor 8 irradiates light to a predetermined area on the intermediate transfer belt 4, detects its reflection light (measurement light), and outputs an electrical signal corresponding to the detected intensity of the reflection light.

Figure 2:
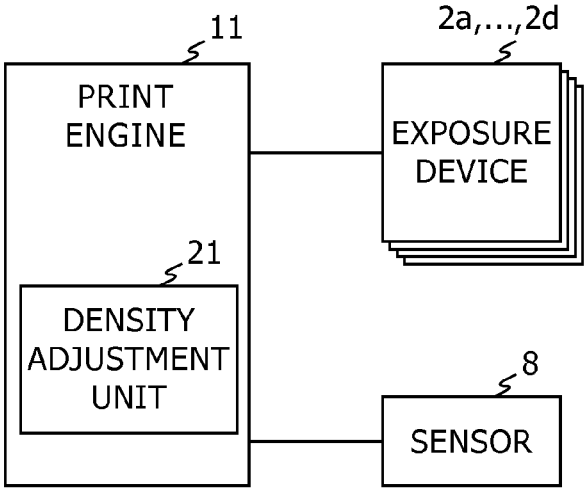
FIG. 2 is a block diagram that shows an electronic configuration of the image forming apparatus in the embodiment according to this invention.

FIG. 2 is a block diagram that shows an electronic configuration of the image forming apparatus in this embodiment according to this invention. In FIG. 2, a print engine 11 is a processing circuit that controls a driving source which drives the aforementioned rollers, a bias induction circuit which induces developing biases and primary transfer biases, and the exposure devices 2*a* to 2*d* in order to feed a paper sheet, print an image on the paper sheet, and output the paper sheet. The developing biases are applied between the photoconductor drums 1*a* to 1*d* and the development units 3*a* to 3*d*, respectively. The primary transfer biases are applied between the photoconductor drums 1*a* to 1*d* and the intermediate transfer belt 4, respectively.

In this embodiment, the print engine 11 has a density adjustment unit 21. For density adjustment, the density adjustment unit 21 causes to develop a cleaner toner image on the photoconductor drums 1*a* to 1*d*, transfer the cleaner toner image onto a surface of the intermediate transfer belt and remove the cleaner toner image. The cleaner toner image is formed to cover a whole area on which a test pattern may be transferred. After removing the cleaner toner image, the density adjustment unit 21 causes to develop the test pattern on the photoconductor drums 1*a* to 1*d* and transfer the test pattern onto the intermediate transfer belt 4. In this embodiment, the cleaner toner image is solidly formed along the whole length of the intermediate transfer belt 4 with a predetermined width. The density adjustment unit 21 identifies toner density of the test pattern on a measurement area, and performs the density adjustment based on the toner density. The toner density is identified from (a) an output value of the sensor 8 corresponding to the measurement light from the measurement area before the test pattern is formed after the cleaner toner image is removed, and (b) an output value of the sensor 8 corresponding to the measurement light from the measurement area which carries the formed test pattern.

Figure 3:
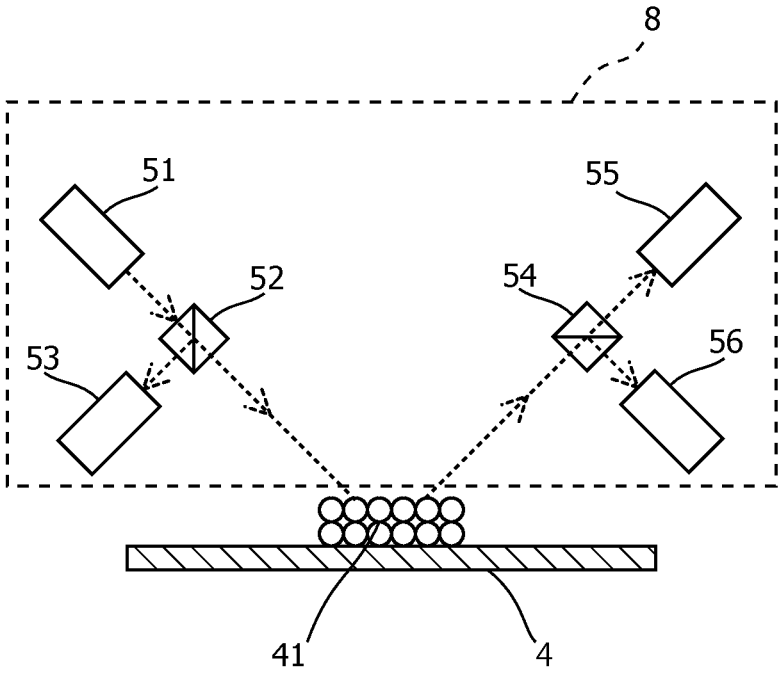
FIG. 3 is a diagram which explains density measurement with a sensor in FIG. 1.

FIG. 3 is a diagram which explains density measurement with the sensor 8 in FIG. 1.

As shown in FIG. 3, the sensor 8 has a light source 51 which emits a light beam, a beam splitter 52 on the light emitting side, a light receiving element 53 on the light emitting side, a beam splitter 54 on the light receiving side, a first light receiving element 55, and a second light receiving element 56.

For instance, the light source 51 is a light emitting diode. The beam splitter 52 transmits a P-polarized component and reflects an S-polarized component in a beam from the light source 51. The light receiving element 53 on the light emitting side is, for instance, a photodiode, and detects the S-polarized component from the beam splitter 52, and outputs an electrical signal corresponding to the detected intensity of the S-polarized component. This signal is used for stabilizing control of the light source 51.

The P-polarized component light transmitted through the beam splitter 52 on the light emitting side is incident to a surface (i.e. either a toner image 41 or the surface material) of the intermediate transfer belt 4 and reflects. This reflection light contains a specilar reflection component and a diffuse reflection component. The specilar reflection component is P-polarized.

The beam splitter 54 transmits a P-polarized component (i.e. the specilar reflection component) and reflects an S-polarized component in the reflection light. The first light receiving element 55 is, for instance, a photodiode, and detects the P-polarized component from the beam splitter 54, and outputs an electrical signal corresponding to the detected intensity of the P-polarized component. The second light receiving element 56 is, for instance, a photodiode, and detects the S-polarized component from the beam splitter 54, and outputs an electrical signal corresponding to the detected intensity of the S-polarized component.

The density adjustment unit 21 calculates toner density from an output of the first light receiving element 55 and an output of the second light receiving element 56 with taking into account a correction amount of the toner density.

Figure 4:
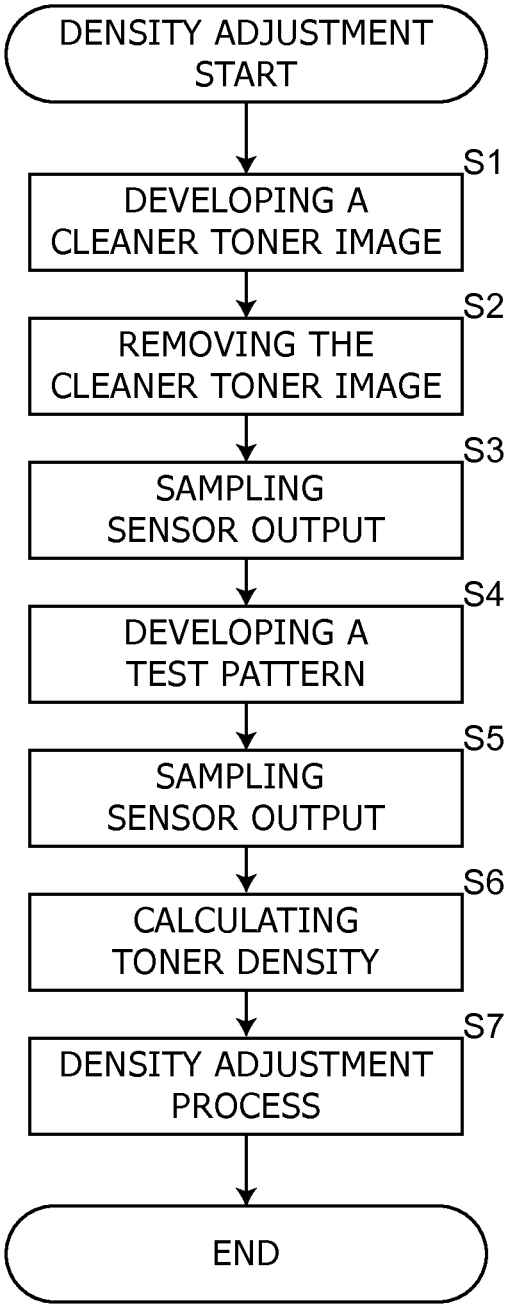
FIG. 4 is a flowchart that explains toner density adjustment in the image forming apparatus shown in FIGS. 1 and 2.

Hereinafter, toner density adjustment in this image forming apparatus is explained. FIG. 4 is a flowchart that explains toner density adjustment in the image forming apparatus shown in FIGS. 1 and 2. FIGS. 5A to 5E show an instance of surface condition change of the intermediate transfer belt 4 in the image forming apparatus shown in FIGS. 1 and 2.

Figure 5A:
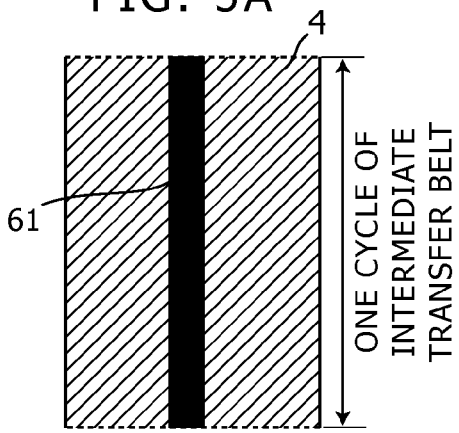
FIGS. 5A to 5E show an instance of surface condition change of an intermediate transfer belt in the image forming apparatus shown in FIGS. 1 and 2.

After starting rotation of the intermediate transfer belt 4 by the driving rollers 5, the density adjustment unit causes to develop a cleaner toner image 61 on the photoconductor drums 1*a* to 1*d*, and transfer the cleaner toner image 61 to the intermediate transfer belt 4 (Step S1, see FIG. 5A).

The cleaner toner image 61 transferred on the intermediate transfer belt 4 is removed by the roller 7 (Step S2). By removing the cleaner toner image 61, the amount of an external additive which adheres on an area 71 which carried the cleaner toner image 61 becomes uniform (see FIG. 5B).

The density adjustment unit 21 obtains an output value of the sensor 8 by sampling the output of the sensor 8 which detects the reflection light from a predetermined area in the area 71 where the cleaner toner image 61 was carried and removed on the surface of the intermediate transfer belt 4 (Step S3). Since a test pattern has not been formed yet, this output value corresponds to the reflectance of a surface material of the intermediate transfer belt 4.

Figure 5D:
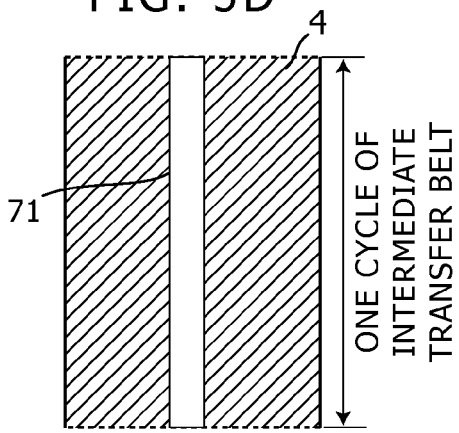
Figure 5B:
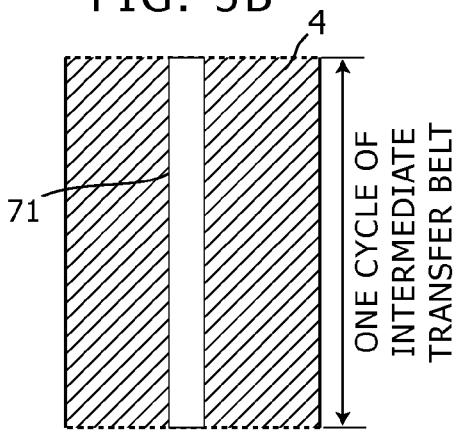
Figure 5E:
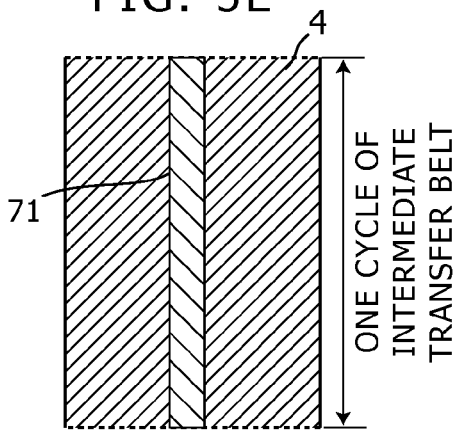
Figure 5C:
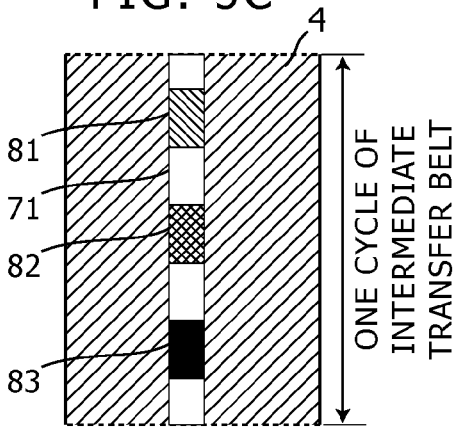
Figure 6A:
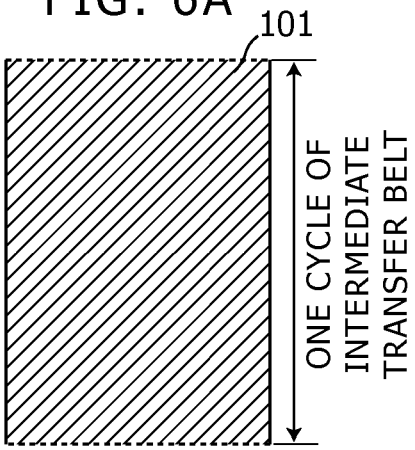
FIGS. 6A to 6F show an instance of surface condition change of an intermediate transfer belt.
Figure 6D:
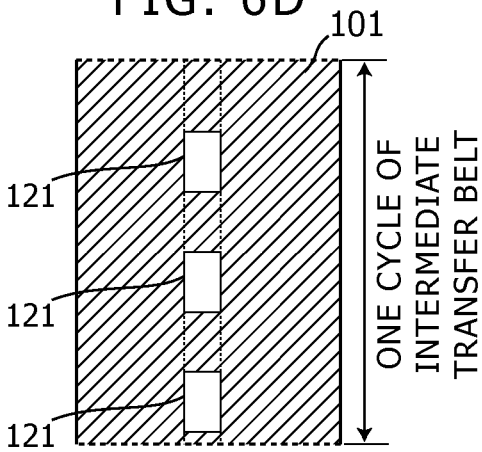
Figure 6B:
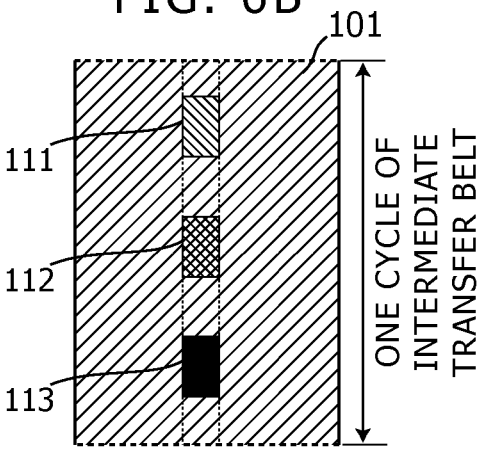
Figure 6E:
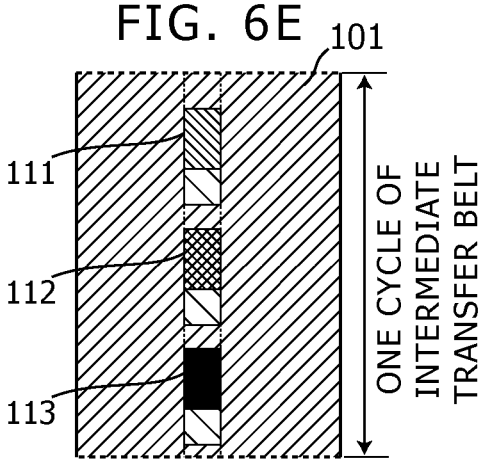
Figure 6C:
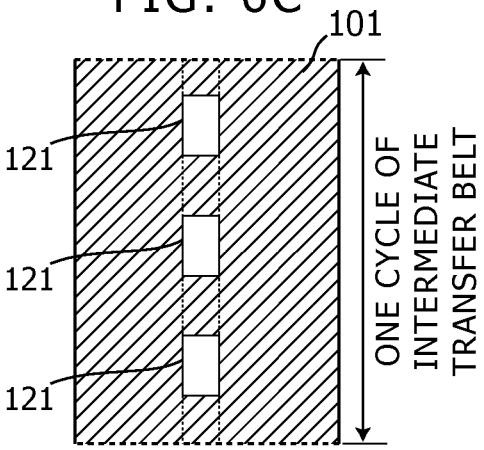
Figure 6F:
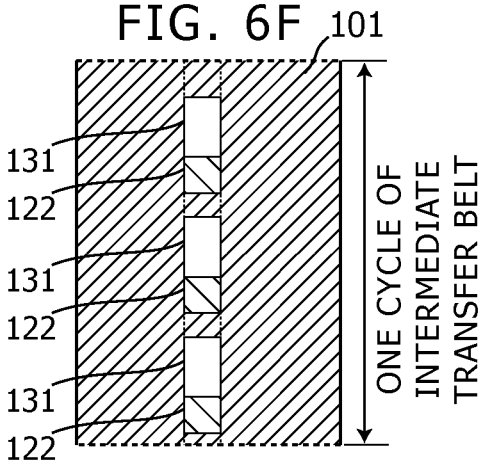

The density adjustment unit 21 causes to form a test pattern on the predetermined area in the area 71 where the cleaner toner image 61 was carried (Step S4, see FIG. 5C). The test pattern contains respective patch images 81 to 83 corresponding to different densities. Partial toner images with different colors are formed on the photoconductor drums 1*a* to 1*d*, and transferred onto the intermediate transfer belt 4 to form the test pattern. For example, the test pattern is formed so as to contain areas with different toner densities of each color.

The density adjustment unit 21 obtains an output value of the sensor 8 by sampling the output of the sensor 8 which detects the reflection light from the test pattern (Step S5).

As mentioned above, after sampling the output of the sensor 8 which detects the reflection light from the test pattern area (i.e. the area on which the test pattern is transferred) before and after toner development of the test pattern, the density adjustment unit 21 calculates toner densities (step S6) of the test pattern from the difference between the output values of the sensor 8 before and after transferring the test pattern.

For instance, the density adjustment unit 21 calculates a toner density CTD according the following formula.

$$CTD = \left(1 - \frac{(P - P0) - (S - S0)}{(Pg - P0) - (Sg - S0)}\right) \times 1000$$

Here, P is the output value of the first light receiving element 55 (i.e. the spacilar reflection component) corresponding to the test pattern area after forming the test pattern; S is the output value of the second light receiving element 56 (i.e. the diffuse reflection component) corresponding to the test pattern area after forming the test pattern; P0 is the output value of the first light receiving element 55 corresponding to its dark voltage; S0 is the output value of the second light receiving element 56 corresponding to its dark voltage; Pg is the output value of the first light receiving element 55 (i.e. the spacilar reflection component) corresponding to the test pattern area before forming the test pattern; and Sg is the output value of the second light receiving element 56 (i.e. the diffuse reflection component) corresponding to the test pattern area before forming the test pattern.

After measuring the toner densities according to the aforementioned manner, the density adjustment unit 21 changes process conditions such as developing bias with taking into account the toner densities in order to adjust the toner image density (Step S7).

The test pattern on the intermediate transfer belt 4 is removed by the roller 7 (see FIG. 5D). After removing the test pattern, even if an external additive adheres on the area 71 on which the cleaner toner image 61 was carried (see FIG. 5E), in the next density adjustment, a cleaner toner image 61 is transferred and removed in the same manner, and consequently at the density adjustment, the amount of the external additive in the area 71 is maintained to be uniform.

According to the aforementioned embodiment, the density adjustment unit 21 causes to transfer the cleaner toner image 61 onto a surface of the intermediate transfer belt 4 and remove the cleaner toner image 61 for the density adjustment. The cleaner toner image 61 is formed to cover a whole area on which a test pattern may be transferred. After removing the cleaner toner image 61, the density adjustment unit 21 causes to transfer the test pattern onto the intermediate transfer belt 4.

When the cleaner toner image 61 is removed by the roller 7, an external additive which adheres on an area where the cleaner toner image 61 is formed is removed together with the cleaner toner image 61, and therefore, the amount of the external additive on an area which will carry the test pattern is maintained to be uniform. Consequently, correct toner density is measured even if an external additive is attached to toner, and toner density adjustment is performed correctly.

The description of the present invention has been presented for purposes of illustration and description, and is not intended to be exhaustive or limited to the invention in the form disclosed. Many modifications and variations will be apparent to those of ordinary skill in the art.

For example, although the image forming apparatus of the aforementioned embodiment is an indirect-transfer image forming apparatus (i.e. having an intermediate transfer member), this invention can also be applied to a direct-transfer image forming apparatus. In the direct-transfer image forming apparatus, photoconductor drums carry the cleaner toner image and the external additive is removed with the cleaner toner image.

Figure 7:
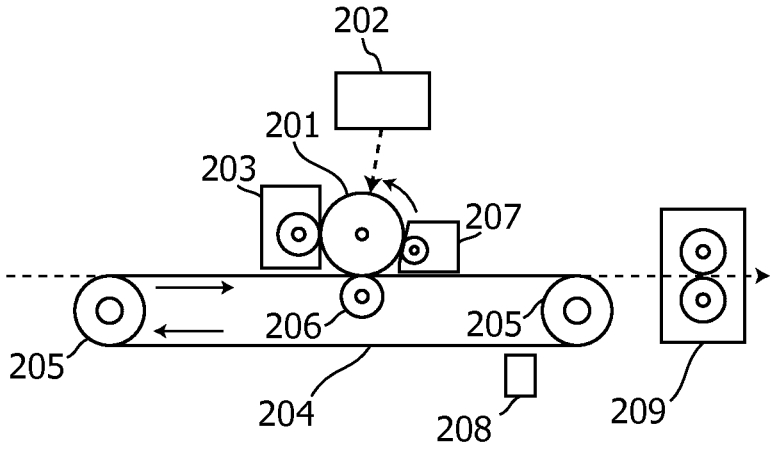
FIG. 7 is a side view that partially shows a mechanical internal configuration of a direct-transfer image forming apparatus in an embodiment according to this invention.

Toner density adjustment of the direct-transfer image forming apparatus is specifically explained with reference to FIG. 7. FIG. 7 is a side view that partially shows a mechanical internal configuration of a direct-transfer image forming apparatus in an embodiment according to this invention. In this image forming apparatus, a development device has a photoconductor drum 201, an exposure device 202, and a development unit 203. The exposure device 202 forms an electrostatic latent image by irradiating laser light to the photoconductor drum 201. A toner container which contains black toner is attached to the development unit 203. In the development unit 203, the toner is supplied from the toner container and this toner and carrier compose a developer. An external additive such as titanium oxide is attached to the toner. The development unit 203 forms a toner image by attaching the toner to an electrostatic latent image on the photoconductor drum 201. In the direct-transfer image forming apparatus, a handler belt 204 rotates by driving force from driving rollers 205, and conveys a paper sheet (i.e. a record medium) to the photoconductor drum 201. A transfer roller 206 makes the paper sheet contact the photoconductor drum 201, and transfers a toner image on the photoconductor drum 201 to the paper sheet. The paper sheet on which the toner image has been transferred is conveyed to a fixer 209, and consequently, the toner image is fixed on the paper sheet. As mentioned above, printing is performed by a direct-transfer system.

In the direct-transfer image forming apparatus, for toner density adjustment, a test pattern is transferred from the photoconductor drum 201 to the handler belt 204. This image forming apparatus has a printer engine similar to the print engine 11. A sensor 208 is the same as the sensor 8, and irradiates light to a predetermined area on the handler belt 204, detects its reflection light (measurement light), and outputs an electrical signal corresponding to the detected intensity of the reflection light. This signal is output to a density adjustment unit in the printer engine the same as the density adjustment unit 21. After measuring toner density, the test pattern which has been transferred on the handler belt 204 is collected by the photoconductor drum 201, and removed from the photoconductor drum 201 by a cleaning device 207.

In the direct-transfer image forming apparatus, as well as the indirect-transfer image forming apparatus, the density adjustment unit causes to transfer the cleaner toner image onto a surface of the handler belt 204. This cleaner toner image is formed to cover a whole area on which the test pattern may be transferred. The density adjustment unit causes the photoconductor drum 201 and the cleaning device 207 to remove the cleaner toner image on the handler belt 204. After removing the cleaner toner image, the density adjustment unit causes the handler belt 204 to carry the test pattern. The density adjustment unit identifies toner density of the test pattern on a measurement area, and performs the density adjustment based on the toner density. The toner density is identified from (a) an output value of the sensor 208 corresponding to the measurement light from the measurement area before the test pattern is formed after removing the cleaner toner image, and (b) an output value of the sensor 208 corresponding to the measurement light from the measurement area which carries the formed test pattern. Therefore, the direct-transfer image forming apparatus carries the cleaner toner image on the handler belt 204, and collects the cleaner toner image from the handler belt 204 to the photoconductor drum 201. An external additive is removed with the cleaner toner image.

Furthermore, in the aforementioned embodiment, the cleaner toner image may be developed with toner of one color. Furthermore, in the aforementioned embodiment, the cleaner toner image may be developed with toner of different colors at different times of density adjustment.

Furthermore, this invention can be applied to an indirect-transfer monochrome image forming apparatus and a direct-transfer color image forming apparatus.

Furthermore, toner on the intermediate transfer belt 4 is removed by the roller 7 in the aforementioned embodiment. Alternatively, the toner may be removed by the photoconductor drums 1*a* to 1*d*.

Furthermore, instead of the output of the sensor 8 before forming the test pattern, the output of the sensor 8 corresponding to one or two areas before and/or after the formed test pattern (i.e. the output of the sensor 8 corresponding to one or two areas on which the test pattern is not formed) may be used.

What is claimed is:

1. An image forming apparatus, comprising:

an image carrier that carries a toner image;

a sensor that detects measurement light from a test pattern on a surface of the image carrier for density adjustment; and a density adjustment unit that causes to form a cleaner toner image on the surface of the image carrier and remove the cleaner toner image for the density adjustment, and causes to form the test pattern after removing the cleaner toner image, the cleaner toner image covering a whole area on which the test pattern may be formed; wherein:

the density adjustment unit identifies toner density of the test pattern on a measurement area, and performs the density adjustment based on the toner density, and the toner density is identified from an output value of the sensor corresponding to the measurement light from the measurement area before the test pattern is formed after the cleaner toner image is removed, and an output value of the sensor corresponding to the measurement light from the measurement area which carries the formed test pattern.

2. The image forming apparatus according to claim 1, further comprising:

a cleaning device that removes toner on the image carrier;

wherein toner used for the toner image has an external additive, and the cleaning device removes the external additive with the toner carried on an area on which the external additive adheres.

3. The image forming apparatus according to claim 2, further comprising:

a photoconductor; and a development unit that develops the toner image on the photoconductor;

wherein the image carrier is an intermediate transfer member on which the toner image is transferred from the photoconductor, and the density adjustment unit causes to form the cleaner toner image on a surface of the intermediate transfer member and remove the cleaner toner image for the density adjustment, and causes to transfer the test pattern to the intermediate transfer member after removing the cleaner toner image.

4. The image forming apparatus according to claim 3, wherein:

the intermediate transfer member is an intermediate transfer belt, and the cleaner toner image is formed along a whole length of the intermediate transfer belt with a predetermined width.

5. The image forming apparatus according to claim 1, further comprising:

a photoconductor; and a development unit that develops the toner image on the photoconductor;

wherein the image carrier is an intermediate transfer member on which the toner image is transferred from the photoconductor, and the density adjustment unit causes to form the cleaner toner image on a surface of the intermediate transfer member and remove the cleaner toner image for the density adjustment, and causes to transfer the test pattern to the intermediate transfer member after removing the cleaner toner image.

6. The image forming apparatus according to claim 5, wherein:

the intermediate transfer member is an intermediate transfer belt, and the cleaner toner image is formed along a whole length of the intermediate transfer belt with a predetermined width.

7. An image forming apparatus, comprising:

a handler belt that conveys a record medium to a photoconductor and carries a test pattern for density adjustment;

a sensor that detects measurement light from the test pattern on a surface of the handler belt; and a density adjustment unit that causes to form a cleaner toner image on the surface of the handler belt and remove the cleaner toner image for the density adjustment, and causes to form the test pattern after removing the cleaner toner image, the cleaner toner image covering a whole area on which the test pattern may be formed;

wherein the density adjustment unit identifies toner density of the test pattern on a measurement area, and performs the density adjustment based on the toner density, and the toner density is identified from an output value of the sensor corresponding to the measurement light from the measurement area before the test pattern is formed after the cleaner toner image is removed, and an output value of the sensor corresponding to the measurement light from the measurement area which carries the formed test pattern.

* * * * *